United States Patent [19]

Fujisaki

[11] 4,099,301

[45] Jul. 11, 1978

[54] SLIDE FASTENER COMBINATION

[75] Inventor: Yoshinori Fujisaki, Kurobe, Japan

[73] Assignee: Yoshida Kogyo K.K., Japan

[21] Appl. No.: 741,847

[22] Filed: Nov. 15, 1976

[30] Foreign Application Priority Data

Nov. 22, 1975 [JP] Japan ..... 50/158718

[51] Int. Cl.[2] ..... A44B 19/02; A44B 19/36

[52] U.S. Cl. ..... 24/205 R; 24/205.11 R

[58] Field of Search ..... 24/205 R; 29/766, 768

[56] References Cited

U.S. PATENT DOCUMENTS

| | | | |
|---|---|---|---|
| 3,555,627 | 1/1971 | Howell | 24/205.11 R |
| 3,805,339 | 4/1974 | Howell | 24/205.11 R |
| 3,849,841 | 11/1974 | Borzner | 24/205.11 R |
| 3,903,571 | 9/1975 | Howell | 24/205.11 R |

FOREIGN PATENT DOCUMENTS

| | | | |
|---|---|---|---|
| 1,035,706 | 7/1966 | United Kingdom | 24/205 R |

*Primary Examiner*—Bernard A. Gelak

*Attorney, Agent, or Firm*—Bucknam and Archer

[57] ABSTRACT

A pair of assembled slide fastener stringers each have a stringer tape and a row of interlocking elements mounted on and along one edge of the stringer tape. A plurality of sliders are slidably mounted on the rows of interlocking elements, each slider having a head at which the element rows go into and out of the slider in the uncoupled state, and a rear at which the element rows go into and out of the slider in the coupled state. A plurality of bottom end stops are also slidably mounted on the element rows, each bottom end stop having a slider-like structure comprising a head at which the element rows go into and out of the bottom end stop in the uncoupled state, and a rear at which the element rows go into and out of the bottom end stop in the coupled state. The sliders alternate with the bottom end stops and have their heads directed in one direction and toward the heads of the bottom end stops. Alternatively, the sliders are provided in pairs lying head-to-head, and the bottom end stops are also in pairs lying head-to-head, the slider pairs alternating with the end stop pairs.

3 Claims, 12 Drawing Figures

SLIDE FASTENER COMBINATION

BACKGROUND OF THE INVENTION

1. Field of the Invention

The present invention relates to a pair of slide fastener stringers with a plurality of sliders and of bottom end stops both slidably mounted thereon.

2. Prior Art

When slide fasteners are to be sewn onto germents at factories or sold to customers at stores, it is one of the common practices to cut coupled elongate fastener stringers having a plurality of sliders and of bottom end stops to desired stringer lengths each having a slider and a bottom end stop.

One such conventional stringer assembly is shown in FIGS. 10A and 10B comprises a pair of coupled slide fastener stringers F1 having a pair of interlocking rows of elements E, a plurality of sliders S slidably mounted on the element rows and having their heads directed in the same direction, and a plurality of bottom end stops B disposed alternately with the sliders and having a substantially C-shaped cross-section, the bottom end stops being slidable along the rows of elements. The stringers are severed to a desired length with a slider and a bottom end stop at the rear side of the slider being mounted on the cut length. Another prior art proposal shown in FIG. 11 is devoid of the bottom end stops movable along the rows of elements E of the fastener stringers $F_2$.

With these attempts, however, opposed fastener elements at areas A near the heads of the sliders remain disengaged, and the intermeshed elements are liable to start breaking apart from the areas A when subjected to a lateral pull exerted on the stringers $F_1$, $F_2$. When the stringers $F_1$ are accidentally broken apart as illustrated in FIG. 10B, a first slider and bottom stop located at the right-hand side of the separated elements as viewed in FIG. 10B cannot be moved leftwardly to put the uncoupled elements into mutual engagement, and hence must be removed and replaced by a second slider and bottom stop at the left-hand side of the separated elements, the elements being again coupled together as they leave the second slider. If this occurred frequently, it would be tedious and time-consuming to reassemble the removed sliders and bottom stops onto the stringers. Furthermore, the bottom end stops mounted relatively loosely have a tendency to be easily displaced in either direction along the rows of elements.

When it is necessary to cut off a damaged section D of the stringers $F_2$ as shown in FIG. 11, a slider on the damaged section cannot be shifted to a remaining undamaged section of the stringers because the slider when transferred would be prevented from moving further by an uncoupled area A leaving the head of a next retracting slider. Such slider must be removed together with the damaged section and assembled again when necessary.

SUMMARY OF THE INVENTION

Accordingly, it is a primary object of the invention to provide slide fastener stringers having a plurality of sliders and of bottom end stops both slidably mounted thereon, the bottom end stops having a slider-like structure to prevent accidental separation of opposed interlocking elements of the stringers.

It is another object of the invention to provide slide fastener stringers having a plurality of sliders and of bottom end stops both slidably mounted thereon, any slider or bottom stop which is located on a damaged stringer section can be shifted to an undamaged stringer section when the damaged section is to be cut off.

According to the invention, a plurality of sliders slidable along rows of fastener elements have their heads directed in the same direction and are disposed alternately with a plurality of bottom end stops having a slider-like structure slidable along the element rows, the bottom end stop having their heads directed in the same direction. Each of the bottom ends stops has its rear directed toward the rear of each associating slider. Further in accordance with the invention, the sliders are provided in pairs, the sliders in each pair having their heads directed toward one another. The bottom end stops are in pairs. The end stops in each pair are interposed between adjacent slider pairs and have their heads directed toward one another.

Other objects, features, and advantages of the invention will occur from the following description of preferred embodiments when taken in conjunction with the accompanying drawing.

DETAILED DESCRIPTION OF THE PREFERRED EMBODIMENTS

Figure 1:
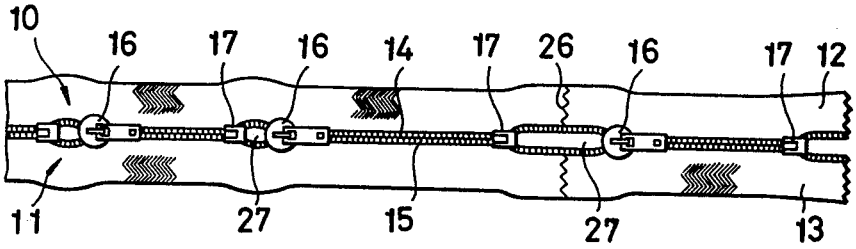
FIG. 1 is a top plan view of a pair of slide fastener stringers with sliders and bottom end stops both slidably mounted thereon.
Figure 3:
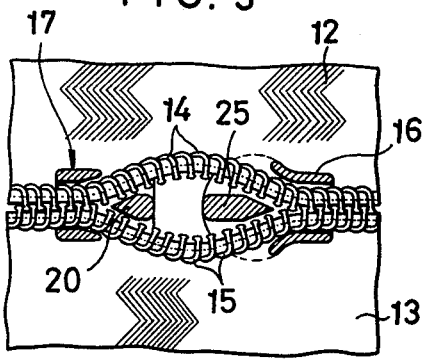
FIG. 3 is an enlarged top plan view of oppositely disposed slider and bottom end stop on the stringers, which both have top wings cut out to show the way opposed rows of interlocking elements are coupled and uncoupled.

FIG. 1 shows a pair of assembled slide fastener stringers 10,11 comprising a pair of stringer tapes 12,13 and a pair of rows of interlocking fastener elements 14,15 represented diagrammatically and mounted on and along the opposed edges of the stringer tapes 12, 13, the stringers 10,11 being put together by interengagement of the fastener elements 14, 15. The coupling elements are shown in FIG. 3 as being helically coiled filaments made of plastic material, but may be plastic filaments in meander form or discrete metal members. The support tapes 12,13 are typically of textile material.

A plurality of sliders 16 are mounted on the fastener elements 14,15 with the slider heads all directed in the same direction. The sliders 16 are located at spaced-apart intervals corresponding to the required separate fastener lengths. A plurality of bottom end stops 17 are also mounted on the fastener elements 14,15, with their heads directed in the same direction, and disposed alternately with the sliders 16 to provide a slider and an associating bottom end stop on each resultant slide fastener. Each of the bottom end stops 17 is located remotely from the associating one of the sliders 16 and has its rear directed toward the rear of the associating slider 16, so that opposed element rows 14,15 remain disengaged between each slider 16 and each successive bottom end stop 17.

Figure 4:
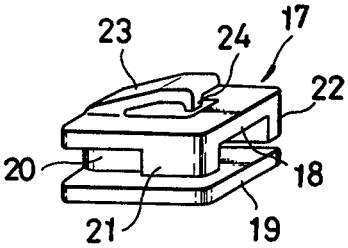
FIG. 4 is an enlarged perspective view of a bottom end stop constructed in accordance with the invention.

As shown in FIGS. 3 and 4, the bottom end stops 17 have a slider-like structure comprising a pair of spaced top and bottom wings 18,19 interconnected by an element guide or separator 20, which serves to divide the coupled element rows into the separated rows as the end stop moves in the fastener-opening direction. An end of each bottom end stop at which the element guide 20 is located is referred to as the head, and the opposite end as the rear. The top wing 18 has a pair of side flanges 21,22 which cooperate with the element guide 20 in forming a generally Y-shaped guide channel in the bottom end stop 17 for the passage therethrough of the rows of fastener elements 14,15. Thus, the opposed rows of elements go into and out of the bottom end stop 17 in the disengaged state at the head thereof, and in the engaged state at the rear thereof. The top wing 18 is cut to form an integral raised member 23 with a downwardly extending projection 24 provided on a free end of the raised member 23 and serving as a locking prong.

The sliders 16 are of a usual construction having a pair of top and bottom wings connected together by an element guide or separator 25. As in the case with the bottom end stop 17, an end of the slider 16 at which the element guide 25 is situated is referred to as the head, and the opposite end as the rear.

To produce an individual slide fastener; a cut is made along a line as at 26 in FIG. 1 to provide a desired length of the fastener stringers 10,11 having a slider and a bottom end stop. It is preferable to retract both the slider and a successive bottom end stop away from each other to facilitate cutting. The cutting of the fastener stringers 10,11 is followed by securing the bottom end stop to a selected position on the stringers 10,11. The bottom end stop is affixed in place by bending or pressing down the member 23 to force the locking prong 24 in between adjacent fastener elements.

With this arrangement, since opposed elements left uncoupled are confined at all times in areas 27 between the slider heads and the next end stop heads as illustrated in FIG. 1, the opposed coupled elements 14,15 are prevented from beginning to separate from the areas 27 even when subjected to external forces tending to break the stringers 10,11 apart. Furthermore, the uncoupled areas 27 can be adjusted in length by moving both the sliders 16 and the bottom end stops 17 having a slider-like structure. Since each associating slider and end stop are arranged with their rear ends directed toward one another, they can be shifted together out of any damaged section of the fastener stringers that is to be discarded.

Figure 2:
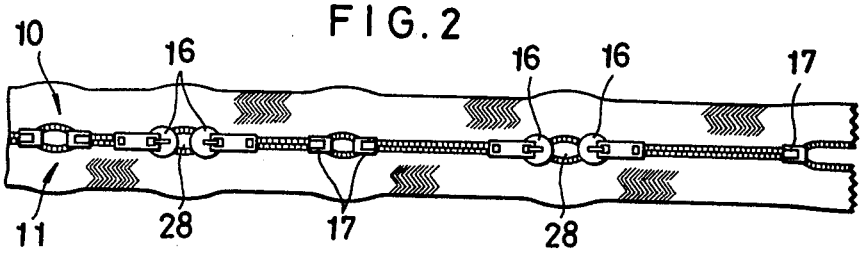
FIG. 2 is a view similar to FIG. 1 but showing another arrangement of the sliders and bottom end stops on the stringers.

According to another arrangement shown in FIG. 2, the sliders 16 are mounted upon the assembled stringers 10,11 in pairs, the sliders in each pair having their heads directed toward one another. Likewise, the bottom end stops 17 are mounted upon the assembled stringers 10,11 in pairs, the end stops in each pair being interposed between adjacent slider pairs and having their heads directed toward one another so as to provide slide fasteners in pairs lying top-to-top.

With this modified arrangement, areas 28 where the opposed element rows 14,15 remain uncoupled are provided between the sliders 16 in each pair and between the bottom end stops 17 in each pair.

Figure 5:
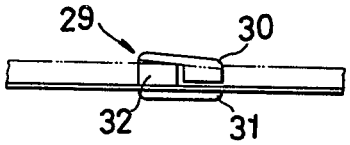
FIG. 5 is a side elevational view of a modified bottom end stop.
Figure 6:
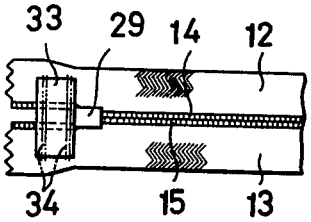
FIGS. 6 through 8 are top plan views showing a variety of ways of affixing the bottom end stop illustrated in FIG. 5 to the slide fastener stringers.
Figure 7:
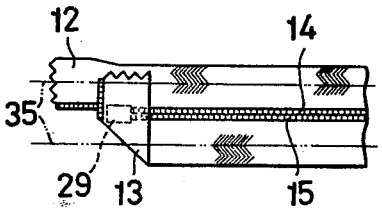
Figure 8:
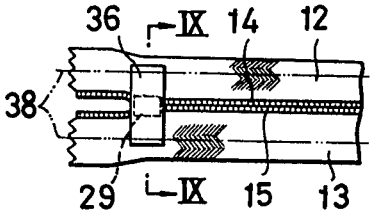
Figure 9:
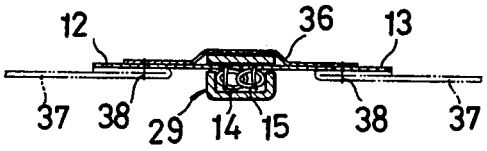
FIG. 9 is a cross-sectional view taken along line IX-IX of FIG. 8.
Figure 10A:
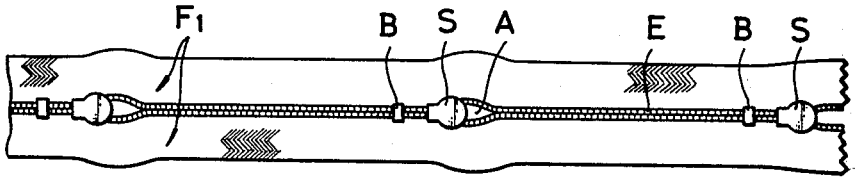
FIG. 10A PRIOR ART
FIG. 10A is a top plan view of slide fastener stringers with sliders and conventional bottom end stops both slidably mounted thereon.
Figure 10B:
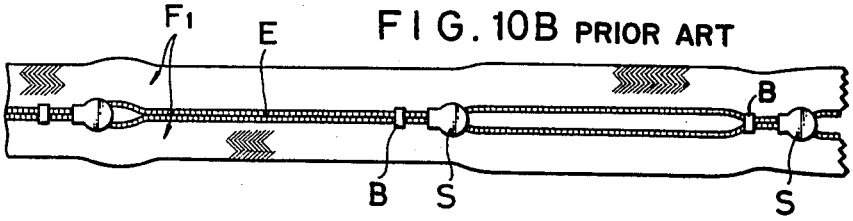
FIG. 10B PRIOR ART
FIG. 10B is a top plan view of the arrangement of FIG. 10A, but in which the stringers are partly broken apart.
Figure 11:
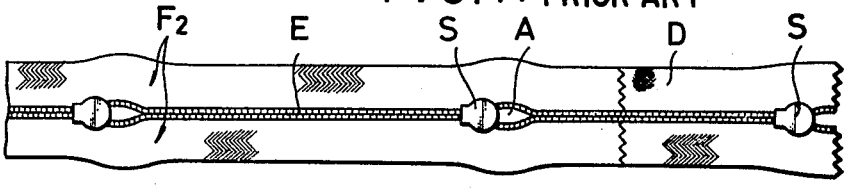
FIG. 11 PRIOR ART
FIG. 11 is a top plan view of another prior-art arrangement that is devoid of bottom end stops.

FIG.5 illustrates a modified bottom end stop 29 which is made by die-casting plastics material or metal, and is devoid of the integral raised member 23 shown in FIG. 4. The bottom end stop 29 comprises a top wing 30 and a bottom wing 31 connected together by an element guide 32. The bottom end stop 29 is secured firmly in position by forcing the rear ends of the top and bottom wings toward each other into biting engagement with the fastener elements 14,15. Further alternative are available for fixing the bottom end stop 29 as shown in FIGS. 6 through 8. In FIG. 6, an attachment strip 33 such as a tape fabric is put partly over the end stop 29 and the stringer tapes 12,13, and is sewn thereto with stitchings 34. According to an embodiment shown in FIG. 7, an end of one of the stringers is folded on itself over and across the rows of elements 14,15 so as to cover the bottom end stop 29. The stringer tapes 12,13 are then sewn to a garment (not shown) with lines of stitching 35. FIGS. 8 and 9 illustrate an attachment strip 36 placed over and bonded to the bottom end stop 29 and the stringer tapes 12,13, which are then stitched to a garment 37 along lines 38.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In combination; a pair of elongated slide fastener stringers each having a stringer tape and a row of fastener elements mounted on and along one edge of said stringer tape, the fastener elements of one row and tape being interlockable with the fastener elements of the other row and other tape; a plurality of pairs of dissimilar coupler-decoupler devices slidably mounted on said rows of fastener elements and moveable therealong to selectively couple into interlocking engagement and decouple from such interlocking engagement the fastener elements within lengthwise portions of said rows thereof, each coupler-decoupler device having a head end at and from which said rows of fastener elements extend in separated, decoupled relation, and a rear end at and from which said rows of fastener elements extend in interlocking, coupled relation, said pairs of coupler-decoupler devices being arranged in spaced succession along said rows of fastener elements with the head end of each coupler-decoupler device in each pair facing the head end of a coupler-decoupler device of the next adjoining pair thereof whereby lengthwise portins of said rows of fastener elements extending between the head ends of coupler-decoupler devices of adjoining pairs thereof, are maintained in separated, decoupled relation, and lengthwise portions of said rows of fastener elements extending between the rear ends of the coupler-decoupler devices of the same pair thereof, are maintained in coupled, interlocking relation.

2. A combination according to claim 1 wherein each of said pairs of coupler-decoupler devices includes as one of said devices a bottom end stop which can be secured to said rows of fastener elements at a selected lengthwise position therealong, and includes as the other of said devices a slider.

3. A combination according to claim 2, each of said bottom end stops comprising a top wing and a bottom wing interconnected by an element guide, said top wing being cut to form an integral raised member having a projection on its free end, and said raised member being bendable to force said projection in between adjacent fastener elements.

* * * * *